United States Patent [19]

Henderson, Jr.

[11] 4,162,646

[45] Jul. 31, 1979

[54] TARGET ACQUISITION SYSTEM

[76] Inventor: Joseph M. Henderson, Jr., 8239 Dr. Craik Ct., Alexandria, Va. 22306

[21] Appl. No.: 787,679

[22] Filed: Apr. 14, 1977

[51] Int. Cl.[2] ..... F41G 3/22

[52] U.S. Cl. ..... 89/41 EA

[58] Field of Search ..... 33/233, 235, 244, 246, 33/249, 252, 254, 257, 258, 259, 260; 42/1 S; 89/37 B, 37.5 R, 40 E, 41 EA; 350/10; 356/253, 254, 255

[56] References Cited

U.S. PATENT DOCUMENTS

| | | | |
|---|---|---|---|
| 453,545 | 6/1891 | Canet | 89/37 B |
| 1,509,267 | 9/1924 | Sperry | 89/41 EA |
| 2,948,188 | 8/1960 | Kollmorgen | 33/246 |
| 3,016,802 | 1/1962 | Grunenberg | 89/40 E |
| 3,138,994 | 6/1964 | Blunk | 89/37.5 R |

*Primary Examiner*—Stephen C. Bentley

*Attorney, Agent, or Firm*—Joseph E. Rusz; Henry S. Miller

[57] ABSTRACT

An optical gunsight retractably mounted on the canopy rail of an aircraft having a luminous pip or reticle for sighting a target. The gunsight may be boresighted in azimuth and elevation to any onboard target designation system to aid in immediate target acquisition by that onboard designator system.

3 Claims, 1 Drawing Figure

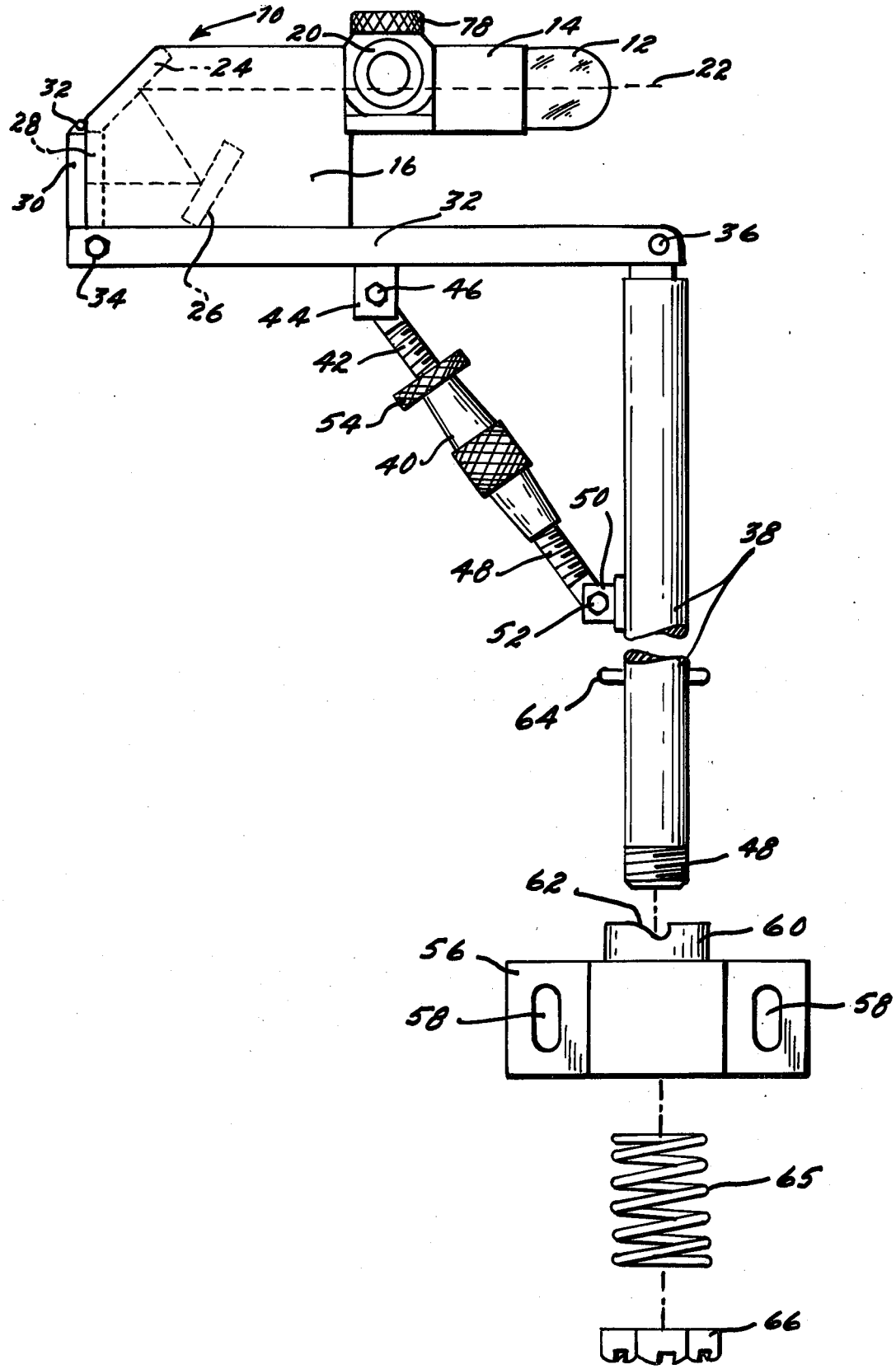
70
20
78
14
12
24
22
32
28
30
16
32
36
34
26
44
46
42
54
40
50
38
48
52
64
48
62
60
56
58
58
65
66

TARGET ACQUISITION SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to target acquisition systems and more particularly to such systems that are used in conjunction with an airborne platform.

Although there are a number of reasons for target acquisition systems to be associated with airborne platforms, the most prominent are for directing photo recognizance and for aiming weapons systems. Target acquisition systems for the latter purposes, in general, involve the use of advanced target sensing devices. However, the most effective target acquisitions system, particularly for close support of ground operations is the vision of the pilot. Unfortunately with current target acquisition systems, it requires a substantial amount of time for the computerized system to acquire the target once the pilot of the aircraft has made initial visual contact. The aircraft must be maneuvered until the computerized ranging devices lock on the target.

Time spent in performing these maneuvers exposes the aircraft to counter action and as a result should be minimized to the greatest extent possible. This is particularly so in systems which require the ordinance to guide to a target on the ground designated by an aircraft.

The invention presented herein allows the computerized target acquisition and designation system to find the target at the instant the pilot places the pip on the target, thereby eliminating time ordinarily required between initial visual contact and designator system acquisition.

SUMMARY OF THE INVENTION

The invention relates to an optical gunsight mounted in an aircraft that is boresighted in cooperation with a computerized target acquisition and designation system.

The sight is an optical non-magnifying device which produces a luminous dot in the center of the viewer. As the pilot looks through the sight, the dot or reticle becomes superimposed on the target, but unlike a conventional sight, the dot does not obliterate the target. Both the dot and target are visible. When the dot is "on" the target, the pilot then activates the computer for the acquisition designation system and the conventional system is locked directly on the target. There is no need for the target acquisition system to search since the optical sight is boresighted with the designator on the aircraft.

The optical sight is positioned on the left front canopy rail in an aircraft. It is mounted so as to be retractable and stored when not in use. The invention differs from conventional sights in that it is primarily designed and utilized as a side acquisition device. It is easily and accuratly bore-sighted with a laser designator or other target acquisition systems. Further, the signt is completely self contained with a reticle dot generated from available light, thereby eliminating the need for batteries or electrical connections. It also works at night with illumination provided by flares.

It is therefore an object of the invention to provide a new and improved target acquisition system.

It is another object of the invention to provide a new and improved target acquisition system that is more efficient than any known similar system.

It is a further object of the invention to provide a new and improved target acquisition system that is substantially less expensive than any known like system.

It is still another object of the invention to provide a new and improved target acquisition system that is more efficient than any known similar system.

It is a further object of the invention to provide a new and improved target acquisition system that is substantially less expensive than any known like system.

It is still another object of the invention to provide a new and improved target acquisition system that is self contained and needs no outside connections.

It is still a further object of the invention to provide a new and improved target acquisition system that is easily and accurately boresighted with computerized guidance systems.

It is another object of the invention to provide a new and improved target acquisition system that will function during hours of darkness with the aid of artificial light.

It is another object of the invention to provide a new and improved target acquisition system which is economical to produce and utilizes conventional, currently available components that lend themselves to standard production manufacturing techniques.

These and other advantages, features and objects of the invention will become more apparent from the following description taken in connection with the illustrative embodiment in the accompanying drawing.

DESCRIPTION OF THE DRAWING

The FIGURE is a side view of the invention partly exploded.

DESCRIPTION OF THE PREFERRED EMBODIMENT

Referring now to the FIGURE, an optical gunsight is shown connected to a tube 14 which is connected to the housing 16. Knobs 18 and 20 control movement of the pip or reticle. Light 22 entering the sight through the window 12 is reflected from mirror 24 on to mirror 26 and thence through window 28 where it is viewed by the pilot. A door 30 mounted on a hinge 32 protects window 28 and is swung open during operation.

The sight is secured to member 32 by a continuous nut-bolt azimuth adjusting knob 34 and a pivoting screw aft of number 32 on the drawing. Member 32 is hinged about pivot point 36 to the main support 38. Adjustment for elevation during the boresighting operation by turnbuckle 40. Threaded portion 42 is secured to member 32 by a bifurcated block 44 and nut bolt 46. Similarly, threaded member 48 is mounted in bifurcated member 50 by nut-bolt 52. A lock nut 54 prevents movement of the turnbuckle once the boresighting process has been accomplished.

For mounting the sight in an aircraft, plate 56 is adapted to mount on the canopy rail via holes 58. A soft metal insert 60 is placed in the mount and is provided with a series of grooves 62. Pin 64 is adapted to engage the grooves and allows the sight to be selectively rotated. Spring 64 abuts a recessed portion of the insert 60 and is secured by nut 66 which engages threaded portion of support 38.

In operation, the sight is moved into position and boresighted by means of knob 34 and turnbuckle 40 to the onboard designator system. Once the pip is on the target, the target then appears within the field of view of the designator system for target acquisition and tracking.

It should be understood, of course, that the foregoing disclosure relates to only a preferred embodiment of the invention and that numerous modifications or alterations may be made therein without departing from the spirit and scope of the invention as set forth in the appended claims.

I claim:

1. A target acqusition system including an optical gunsight means comprising:

a gunsight mounting plate, adapted to receive and secure an optical gunsight including means moving said sight in azimuth and being bifurcated at one end; post means having a generally cylindrical shape and adapted to engage said mounting plate pivotally at the bifurcated end, and further having a threaded portion at the end distally from the pivot engaging end, and a cam follower means extending outwardly from the post, transverse to its longitudinal axis; turnbuckle means pivotally attached between said mounting plate and said post providing elevation adjustment about the pivot point between said gunsight mounting plate and the post; an adapter plate including a surface mating plate having an annular aperture for receiving said post and further including a cam ring having a plurality of detents whereby said cam follower will allow only selected rotation of the post means; nut means for engaging the threaded portion of the post, and spring means surrounding the post and mounted between the cam ring and nut thereby applying preselected bias to the cam follower on the cam surface.

2. A target acquisition system according to claim 1 further including means for locking the turnbuckle means.

3. A target acquisition system according to claim 1 further including a continuous nut bolt azimuth adjusting means.

* * * * *